US009223264B2

(12) United States Patent
Kawazu

(10) Patent No.: US 9,223,264 B2
(45) Date of Patent: Dec. 29, 2015

(54) IMAGE HEATING APPARATUS

(75) Inventor: Takao Kawazu, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 600 days.

(21) Appl. No.: 12/907,553

(22) Filed: Oct. 19, 2010

(65) Prior Publication Data

US 2011/0095011 A1 Apr. 28, 2011

(30) Foreign Application Priority Data

Oct. 27, 2009 (JP) ..... 2009-246428

(51) Int. Cl.
*G03G 15/20* (2006.01)

(52) U.S. Cl.
CPC .. *G03G 15/2039* (2013.01); *G03G 2215/00734* (2013.01); *G03G 2215/2035* (2013.01)

(58) Field of Classification Search
CPC ..... G03G 15/20; G03G 15/2078; G03G 2215/00734; G03G 2215/2035
USPC ..... 399/329, 334, 69, 67, 88, 328, 33, 37; 219/483–486, 507–508, 497, 216, 505, 219/494, 619; 323/235, 236, 234, 237
See application file for complete search history.

(56) References Cited

U.S. PATENT DOCUMENTS 4,496,829 A * 1/1985 Black et al. ..... 219/497
5,083,168 A 1/1992 Kusaka et al.
5,149,941 A 9/1992 Hirabayashi et al.
5,162,634 A 11/1992 Kusaka et al.
5,262,834 A 11/1993 Kusaka et al.
5,300,997 A 4/1994 Hirabayashi et al.
5,994,671 A 11/1999 Suzuki et al.
6,018,140 A * 1/2000 Hirose et al. ..... 219/216
6,763,206 B2 * 7/2004 Kinouchi et al. ..... 399/70
7,076,183 B2 7/2006 Kawazu et al.

(Continued)

FOREIGN PATENT DOCUMENTS

JP 63-313182 12/1988
JP 2-157878 6/1990

(Continued)

OTHER PUBLICATIONS

Japanese Office Action in counterpart Japanese Patent Application No. 2009-246428 and English translation thereof.

*Primary Examiner* — Dana Ross
*Assistant Examiner* — Frederick Calvetti
(74) *Attorney, Agent, or Firm* — Fitzpatrick, Cella, Harper & Scinto

(57) ABSTRACT

An image heating apparatus includes first and second heat generating elements, first and second driving elements provided in a passage from a commercial power source to the heat generating elements, respectively, and a portion controlling the driving elements at a control level depending on a detection temperature. At the control level, a renewing period is two cycles of a waveform of an alternating current of the power source or an integral multiple thereof. The control portion controls, during a period when the control portion controls the driving elements at one control level, the driving elements so that the heat generating element to which the power is to be preferentially supplied is switched from the first to the second driving element and the waveform of the alternating current passing through each of the heat generating elements keeps symmetry of positive and negative half-cycle components with respect to a zero-voltage line.

16 Claims, 10 Drawing Sheets

(56) References Cited

U.S. PATENT DOCUMENTS

| | | | | |
|---|---|---|---|---|
| 7,139,500 | B2 | 11/2006 | Kawazu et al. | |
| 7,187,882 | B2 | 3/2007 | Kawazu et al. | |
| 7,283,145 | B2 * | 10/2007 | Kato et al. | 347/156 |
| 7,310,486 | B2 * | 12/2007 | Kawazu et al. | 399/69 |
| 7,599,636 | B2 * | 10/2009 | Kaji et al. | 399/69 |
| 7,970,309 | B2 * | 6/2011 | Sato et al. | 399/69 |
| 2004/0146311 | A1 | 7/2004 | Kawazu et al. | |
| 2006/0051118 | A1 * | 3/2006 | Kaji et al. | 399/69 |
| 2006/0051122 | A1 | 3/2006 | Kawazu et al. | |
| 2006/0078344 | A1 | 4/2006 | Kawazu et al. | |
| 2006/0093388 | A1 * | 5/2006 | Kawazu et al. | 399/69 |
| 2006/0210330 | A1 * | 9/2006 | Sone et al. | 399/328 |
| 2008/0008488 | A1 * | 1/2008 | Kaji et al. | 399/67 |
| 2009/0252520 | A1 * | 10/2009 | Segawa | 399/69 |
| 2009/0257769 | A1 * | 10/2009 | Miyazaki | 399/69 |
| 2014/0079425 | A1 * | 3/2014 | Tanaka et al. | 399/70 |

FOREIGN PATENT DOCUMENTS

| | | | |
|---|---|---|---|
| JP | 9-258598 | | 10/1997 |
| JP | 9-258599 | | 10/1997 |
| JP | 10-10917 | | 1/1998 |
| JP | 10091037 | * | 4/1998 |
| JP | 11-339930 | | 12/1999 |
| JP | 2000-47520 | | 2/2000 |
| JP | 2000-187411 | | 7/2000 |
| JP | 2000268939 | * | 9/2000 |
| JP | 2004-226557 | | 8/2004 |
| JP | 2004226557 | * | 8/2004 |
| JP | 2004-264397 | | 9/2004 |
| JP | 2005-208252 | | 8/2005 |
| JP | 2007-212503 | | 8/2007 |

* cited by examiner

IMAGE HEATING APPARATUS

FIELD OF THE INVENTION AND RELATED ART

The present invention relates to an image heating apparatus using a halogen heater or a ceramic surface heater, and an image forming apparatus including the image forming apparatus.

A conventional image forming apparatus using an electrophotographic process will be described.

A heat fixing device of the image forming apparatus fixes an unfixed image (toner image), formed on transfer paper by an image forming means using the electrophotographic process, on the transfer paper. The heat fixing device of a heating-roller type using the halogen heater as a heat source and the heat fixing device of a film-heating type using the ceramic surface heater as the heat source have been disclosed in, e.g., Japanese Laid-Open Patent Application (JP-A) (Tokkai) Sho 63-313182 and JP-A Hei 2-157878.

Generally, the heater is connected to an AC power source through a switching element such as triac, and electric power is supplied by the AC power source. In the fixing device using the heater as the heat source, a temperature detecting element such as a thermistor (thermosensitive element) is provided. The temperature of the fixing device is detected by the temperature detecting element and on the basis of detected temperature information, a sequence controller effects ON/OFF control of the switching element. As a result, power supply to the heater as the heat source of the fixing device is turned on and off, so that the temperature of the fixing device is controlled so as to become a target temperature. The ON/OFF control of the power supply to the ceramic surface heater is generally effected by phase control or wave-number control of an input commercial power source.

When the electric power is supplied to a high power (output) ceramic surface heater to control the temperature, the phase control is frequently effected in order to realize quick control responsiveness and has been proposed in, e.g., JP-A 2004-226557, JP-A 2005-208252 and JP-A 2007-212503.

On the other hand, in the case where a ceramic surface heater having a low resistance value is subjected to the phase control, current distortion becomes large, and a large amount of harmonic current flows. Further, when wave-number control is effected in order to reduce the harmonic current, voltage fluctuation or flickering occurs.

As a countermeasure against this, the resistance value has been conventionally divided equally into two values for two heat generating elements connected in parallel, and then one of the two heat generating elements has been subjected to the ON/OFF control in a half-wave period and the other heat generating element has been subjected to the phase control in the half-wave period. As a result, it is possible to realize a reduction of the harmonic current and the prevention of the flickering in combination.

However, in recent years, image forming apparatuses are operated at higher speeds, so that there is a need to lower the total resistance value of the heat generating elements. Further, in order to pass various sizes and types of media through the fixing device (image heating apparatus), the control-temperature range and the control-electric-power range have been enlarged. In these cases, there is a need to control a distribution of temperature in the ceramic surface heater with respect to a sheet (paper) passing direction by changing the length and the resistance value of the two heat generating elements. Further, it is also necessary to keep symmetry of the control waveform with respect to positive and negative components.

SUMMARY OF THE INVENTION

The present invention has been accomplished in view of the above-described problems.

A principal object of the present invention is to provide an image heating apparatus capable of suppressing harmonic current.

Another object of the present invention is to provide an image heating apparatus capable of keeping a heat generation (amount) ratio between two heat generating elements while suppressing the harmonic current.

According to an aspect of the present invention, there is provided an image heating apparatus comprising:

a first heat generating element;

a second heat generating element;

a first driving element provided in a power supply passage from a commercial power source to the first heat generating element;

a second driving element provided in a power supply passage from the commercial power source to the second heat generating element;

a temperature detecting element; and a control portion for controlling the first driving element and the second driving element at a control level, depending on a detection temperature of the temperature detecting element, wherein at the control level, a renewing period is two cycles of a waveform of an alternating current of the commercial power source or an integral multiple of the two cycles, and wherein the control portion controls, during a period in which the control portion controls the first driving element and the second driving element at one control level, so that a priority heat generating element to which the power is to be supplied is switched from the first driving element to the second driving element and so that the waveform of the alternating current passing through each of the first heat generating element and the second heat generating element keeps symmetry of positive and negative half-cycle components with respect to a zero-voltage line.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings.

Embodiment 1

Figure 1:
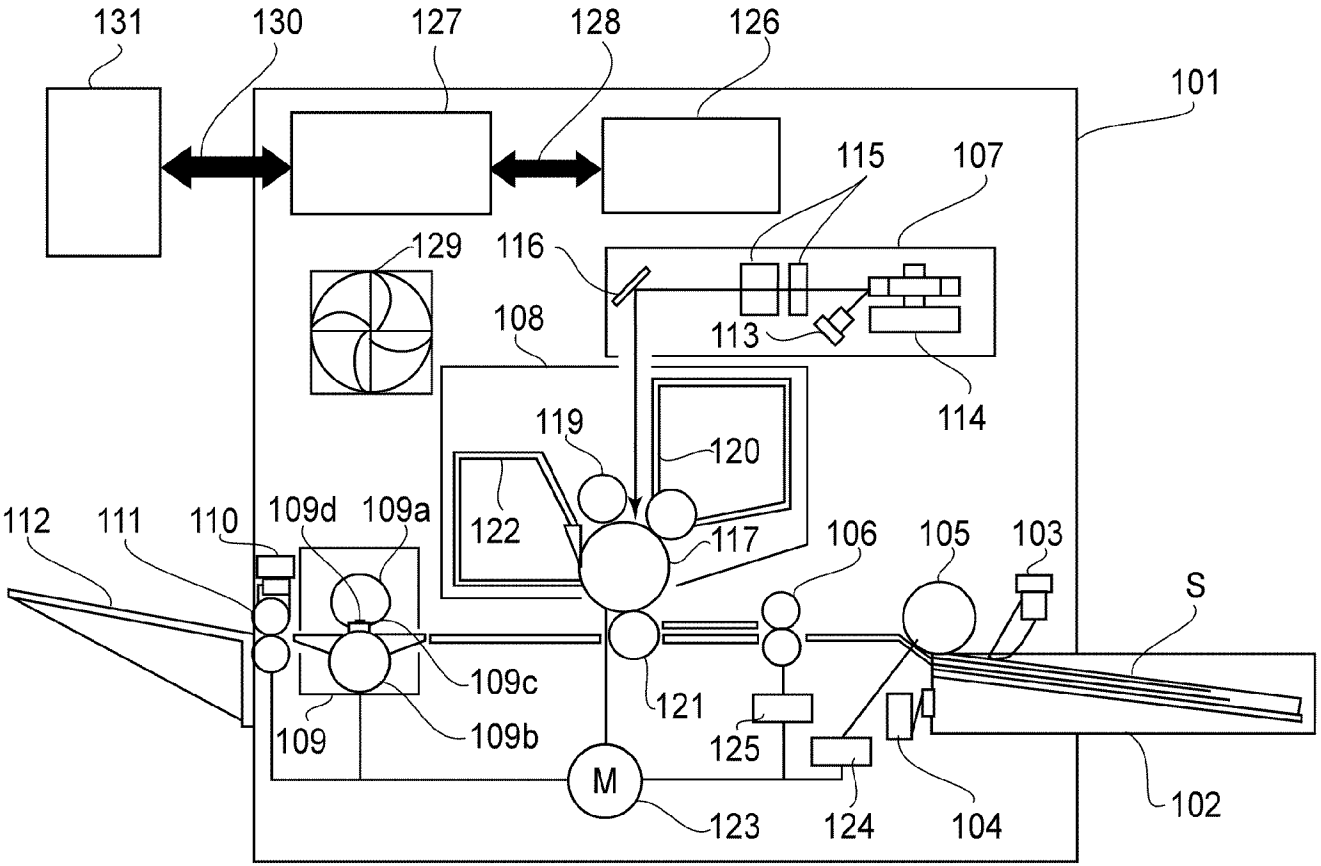
FIG. 1 is a schematic structural view of an image forming apparatus in Embodiment 1.

FIG. 1 is a schematic structural view of an image forming apparatus, using an electrophotographic process, such as a laser printer.

A laser printer main assembly 101 includes a cassette 102 for accommodating recording paper (recording material) S. Further, a cassette presence-absence sensor 103 for detecting the presence or absence of the recording paper S in the cassette 102, a cassette size sensor 104 (constituted by a plurality of micro-switches) for detecting the size of the recording paper S in the cassette 102, a sheet feeding roller 105 for feeding the recording paper S from the cassette 102, and the like are provided. Further, on a downstream side of the sheet feeding roller 105 with respect to a sheet conveyance direction, a registration roller pair 106 for conveying the recording paper S in a synchronous manner is provided. Further, on the downstream side of the registration roller pair 106, an image forming portion 108 for forming a toner image on the recording paper S on the basis of laser light from a laser scanner portion 107 is provided. On the downstream side of the image forming portion 108, a fixing device 109 for heat-fixing the toner image formed on the recording paper S is provided. Further, on the downstream side of the fixing device 109, a sheet discharge sensor 110 for detecting a conveyance state of the recording paper S at a sheet discharging portion, sheet discharging rollers 111 for discharging the recording paper S, and a stacking tray 112 on which the predetermined recording paper S on which recording has been completed is to be stacked are provided. A conveyance reference line of the recording paper S is set as a center line of the recording paper S with respect to a direction perpendicular to the conveyance direction in the image forming apparatus, i.e., with respect to a widthwise direction of the recording paper S.

Further, the laser scanner portion 107 includes a laser unit 113 for emitting the laser light modulated on the basis of an image signal (VDO) sent from an external device 131 described later. The laser scanner portion 107 also includes a polygon motor 114, an imaging lens 115, a folding mirror, and the like for scanning a photosensitive drum 117 with the laser light from the laser unit 113.

Further, the image forming portion 108 is constituted by members necessary for the electrophotographic process, such as the photosensitive drum 117, a primary charging roller 119, a developing device 120, a transfer charging roller 121 and a cleaner 122. Further, the fixing device 109 is constituted by a fixing film (belt) 109*a*, a pressing roller 109*b*, a ceramic surface heater 109*c* provided inside the fixing film 109*a*, and a thermistor 109*d* for detecting a surface temperature.

A main motor 123 supplies a driving force to the sheet feeding roller 105 through a sheet feeding roller clutch 124 and supplies the driving force to the registration roller pair 106 through a registration roller clutch 125. Further, the main motor 123 supplies the driving force to the respective units of the image forming portion 108, and the fixing device 109 and the sheet discharging rollers 111.

An engine controller 126 effects control of the electrophotographic process performed by the laser scanner portion 107, the image forming portion 108 and the fixing device 109 and effects conveyance control of the recording paper S in the main assembly 101.

A video controller 127 is connected to an external device 131 such as a personal computer through a general-purpose interface (Centronics, RS232C, etc.) 130. Then, the video controller 127 develops image information sent from the interface into bit data and sends the bit data to the engine controller 126 as VDO signal.

Figure 2:
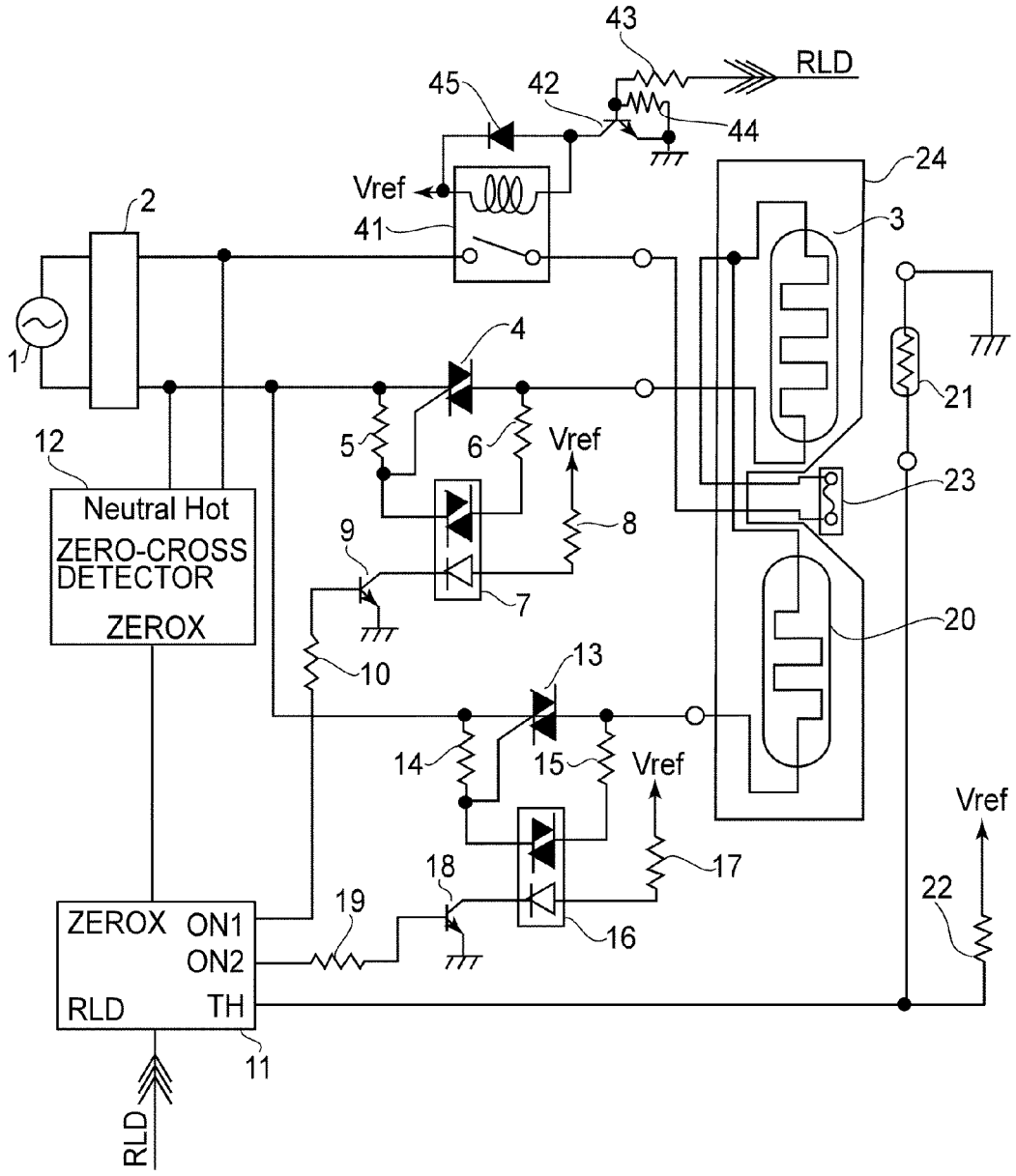
FIG. 2 is a drive and control circuit diagram of a ceramic heater in Embodiment 1.

FIG. 2 shows a drive and control circuit of the ceramic heater in the present invention. An AC power source (commercial power source) 1 for driving the image forming apparatus in this embodiment independently supplies AC engine controller to a heat generating element 3 (first heat generating element) and a heat generating element 20 (second heat generating element 24 (109*c*) through an AC filter 2 and a relay 41, so that the heat generating elements 3 and 20 generate heat. The heat generating elements 3 and 20 have different amounts of heat generation.

The supply of the electric power to the heat generating element 3 is controlled by energization to a triac 4 (first driving element) and interruption of the energization. Resistors 5 and 6 are a bias resistor for the triac 4, and a photo-triac coupler 7 is a device for ensuring a creeping distance of insulation between primary and secondary sides. By energization a light-emitting diode of the photo-triac coupler 7, the triac 4 is turned on. A resistor 8 limits current of the photo-triac coupler 7. The photo-triac coupler 7 is turned on and off by a transistor 9. The transistor 9 is operated in accordance with ON1 signal sent from the engine controller 11 (126) through a resistor 10.

The supply of the electric power to the heat generating element 20 is controlled by energization to a triac 13 (second driving element) and interruption of the energization. Resistors 14 and 15 are bias resistors for the triac 13, and a photo-triac coupler 16 is a device for ensuring a creeping distance of insulation between primary and secondary sides. By energization a light-emitting diode of the photo-triac coupler 16, the triac 13 is turned on. A resistor 17 limits current of the photo-triac coupler 16. The photo-triac coupler 16 is turned on and off by a transistor 18. The transistor 18 is operated in accordance with an ON2 signal sent from the engine controller 11 through a resistor 19.

Further, the AC power source 1 inputs a voltage into a zero-cross detecting circuit 12 through the AC filter 2. The zero-cross circuit 12 notifies the engine controller 11 as a pulse signal that a commercial-power-source voltage is not more than a threshold voltage. Hereinafter, the pulse signal sent to the engine controller 11 is referred to as a "ZE-ROX signal". The engine controller 11 detects an edge of the pulse of the ZEROX signal and with this timing, turned on or off the triac 4 or 13 by phase control or wave-number control.

A temperature detecting element 21 (e.g., a thermistor temperature transducer) for detecting the temperature of the ceramic heater 24 in which the heat generating elements 3 and 20 are provided is disposed on the ceramic heater 24, through an insulative material having a withstand voltage, so as to ensure an insulation distance from the heat generating elements 3 and 20. The temperature detected by the temperature detecting element 21 is detected as divided voltages of a resistor 22 and the temperature detecting element 21 and is A/D-input into the engine controller 11 as TH signal. The temperature of the ceramic heater 24 is monitored as the TH signal by the engine controller 11 and is compared with a set temperature of the ceramic heater 24 to calculate a ratio of electric power to be supplied to the heat generating elements 3 and 20 constituting the ceramic heater 24. Further, under the control condition, the engine controller 11 sends an ON1 signal to the transistor 9 or sends an ON2 signal to the transistor 18.

Further, in the case where a means for supplying the electric power to the heat generating elements 3 and 20 and for controlling the electric power goes out of order and exhibits thermal runaway, as a means for preventing overheating, an overheating preventing means 23 is disposed on the ceramic heater 24. The overheating preventing means 23 is, e.g., a temperature fuse or a thermo-switch. Due to the out-of-order electric power control means, when the heat generating elements 3 and 20 exhibit thermal runaway and the temperature of the overheating preventing means 23 is not less than a predetermined temperature, the overheating preventing means 23 is in an open state to interrupt the energization to the heat generating elements 3 and 20.

Further, with respect to the temperature of the ceramic heater 24 monitored as the TH signal, in the engine controller 11, an abnormal high-temperature detection temperature is set separately from the set temperature for temperature control. In the case where the temperature detected from the TH signal is not less than the abnormal high-temperature detection temperature, the engine controller 11 sets the RLD signal at Low level and turns off the transistor 42 and the relay 41, thus interrupting the energization to the heat generating elements 3 and 20. In general, during the temperature control, the engine controller 11 always sends the RLD signal at a High level to turn on the transistor 42 and the relay 41. A resistor 43 is a current limiting resistor, and a resistor 44 is a bias resistor between a base and an emitter. A diode 45 is an element for absorbing the counter-electromotive force when the relay 41 is turned off.

Figure 3:
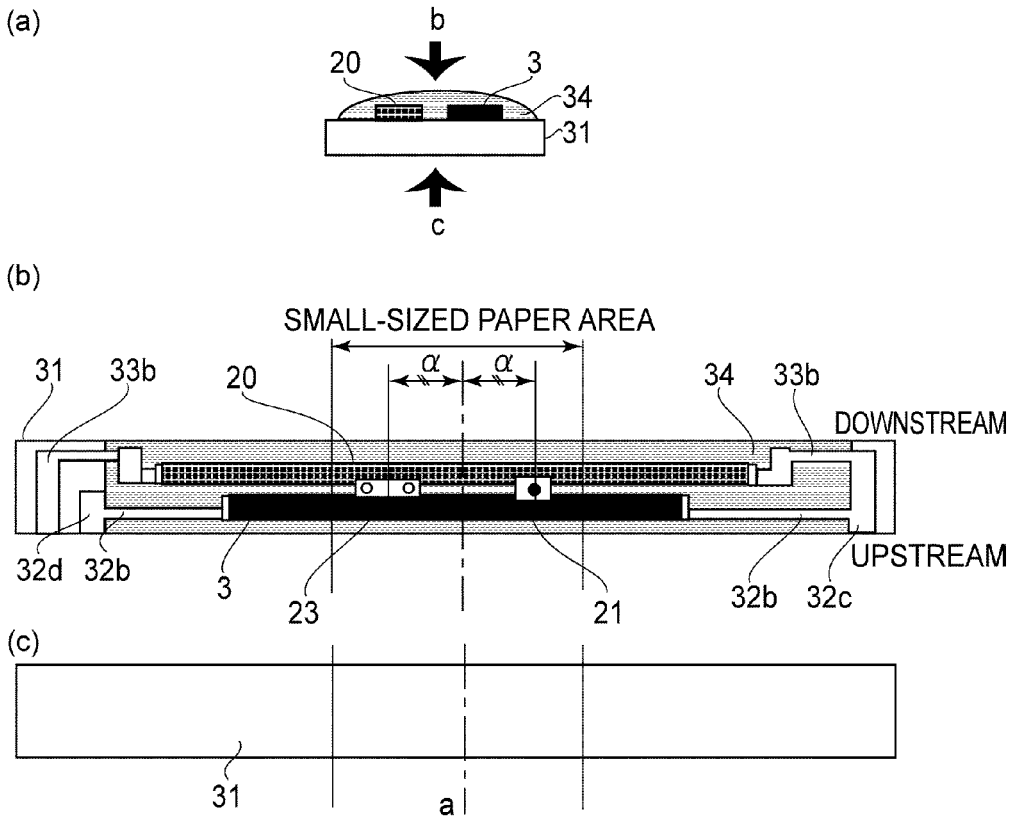
FIGS. 3(*a*), 3(*b*) and 3(*c*) are schematic sectional views of the ceramic heater in Embodiment 1.

The ceramic heater 24 in this embodiment is schematically illustrated in FIGS. 3(*a*), 3(*b*) and 3(*c*). FIG. 3(*a*) is a sectional view of a ceramic surface heater, FIG. 3(*b*) shows a surface on which the heat generating elements 3 and 20 are formed as seen in a "b" direction indicated in FIG. 3(*a*), and FIG. 3(*c*) shows a surface as seen in a "c" direction indicated in FIG. 3(*a*).

The ceramic heater 24 is constituted by an insulated substrate 31 of ceramics such as SiC, AlN or $Al_2O_3$, the heat generating elements 3 and 20 formed on the surface of the insulated substrate 31 with past by screen printing or the like, and a protective layer 34 of glass or the like for protecting the two heat generating elements. On the protective layer 34, the temperature detecting element 21 for detecting the temperature of the ceramic surface heater and the overheating preventing means 23 are provided at bilaterally symmetrical positions with respect to the conveyance reference line of the recording paper, i.e., a center line of the heater 24 with respect to a lengthwise direction and are provided at positions inside ends of a minimum possible predetermined width.

The heater 24 is constituted by the heat generating elements which generate heat when the electric power is to be supplied thereto, electrode portions 32*c*, 32*d* and 33*d* to which a connector is to be connected, and electroconductive portions 32*b* and 33*b* for connecting the electrode portions and the heat generating elements. The electrode portion 32*c* is connected with the two heat generating elements 3 and 20 and is common to the heat generating elements 3 and 20.

Figure 4:
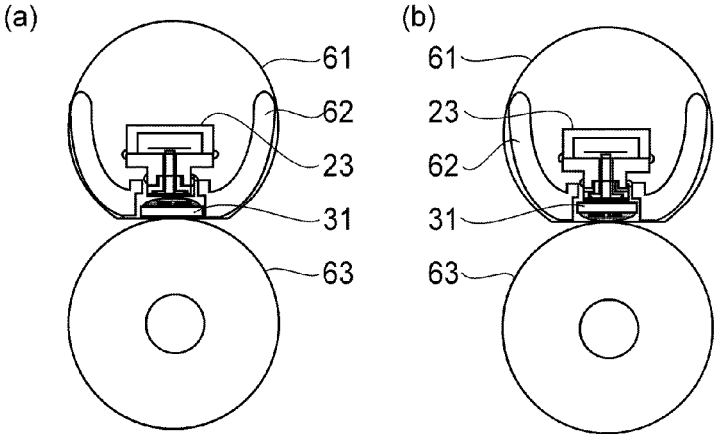
FIGS. 4(*a*) and 4(*b*) are schematic structural views of a fixing device in Embodiment 1.

The common electrode (portion) 32*c* is connected to a HOT-side thermal of the AC power source 1 through the overheating preventing means 23. The electrode portion 32*d* is connected to a neutral terminal of the AC power source 1 through the triac 4 for driving the heat generating element 3. The electrode portion 33*d* is connected to the neutral terminal of the AC power source 1 through the triac 13 for driving the heat generating element 20. The ceramic heater 24 (109*c*) is, as shown in FIGS. 4(*a*) and 4(*b*), supported by a film guide 62. With the film guide 62 supporting the ceramic heater 24 at its lower portion, a cylindrical fixing film 61 (109*a*) of a heat-resistant material is externally engaged. Further, the ceramic heater 24 and a pressing roller 63 (109*b*) are pressed against each other with a predetermined pressure while sandwiching the film 61, thus creating a fixing nip with a predetermined width.

Further, the overheating preventing means 23 is, e.g., a thermostat and contacts the surface of the insulated substrate 31 or the surface of the protective layer 34. The position of the thermostat 23 is corrected by the film guide 62, and a thermo-sensitive surface of the thermostat 23 contacts the surface of the ceramic heater 24. The temperature detecting element 21 also contacts the surface of the ceramic heater 24 although a state thereof is not shown. The ceramic heater 24 may be disposed so that the heat generating elements 3 and 20 are located on an opposite side from a nip side (FIG. 4(*a*)) or so that the heat generating elements 3 and 20 are located on the nip side (FIG. 4(*b*)). Further, in order to improve its sliding property, at an interface between the film 61 and the ceramic heater 24, sliding grease may be applied.

Figure 5:
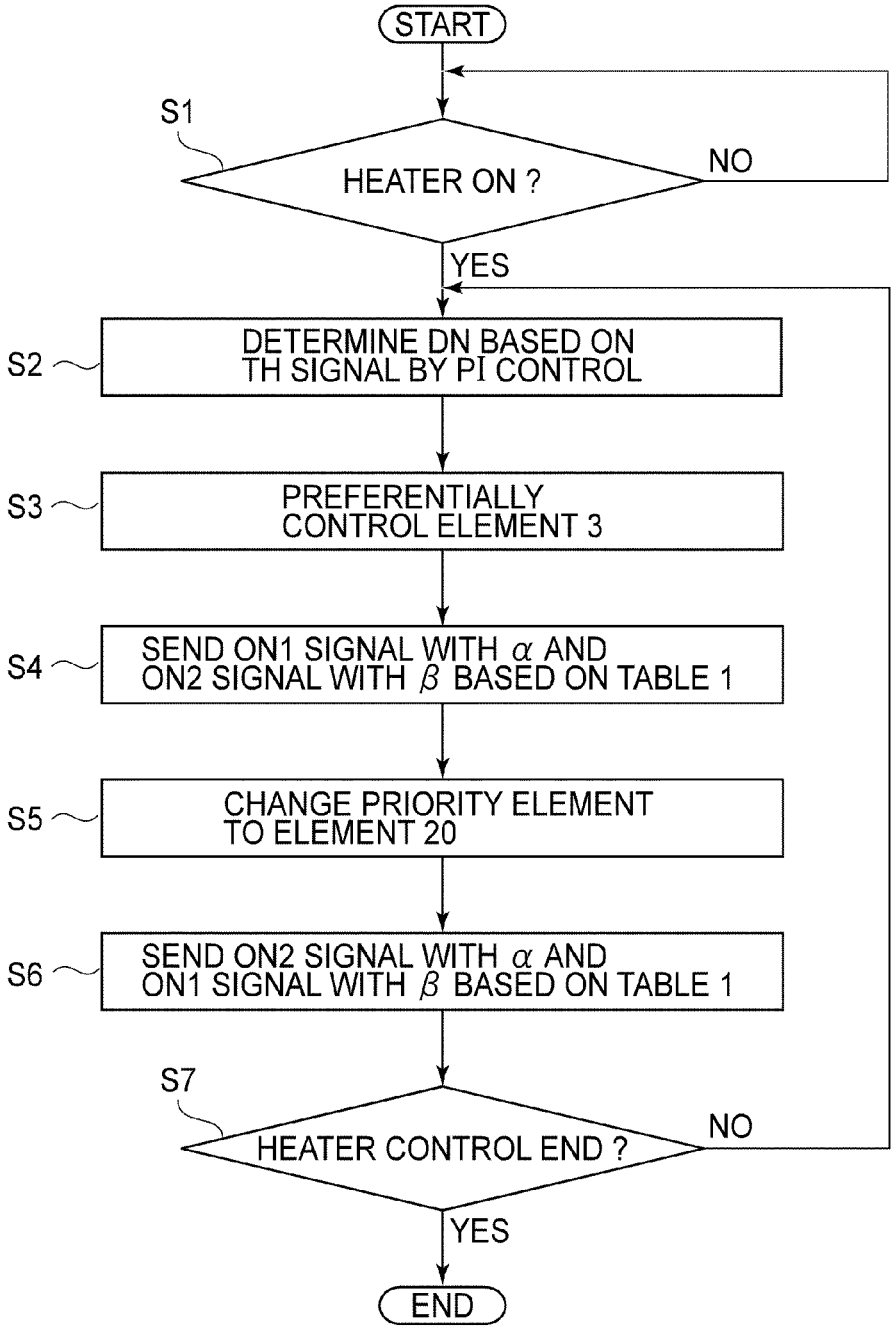
FIG. 5 is a flow chart of a control sequence of the fixing device in Embodiment 1.
Figure 6:
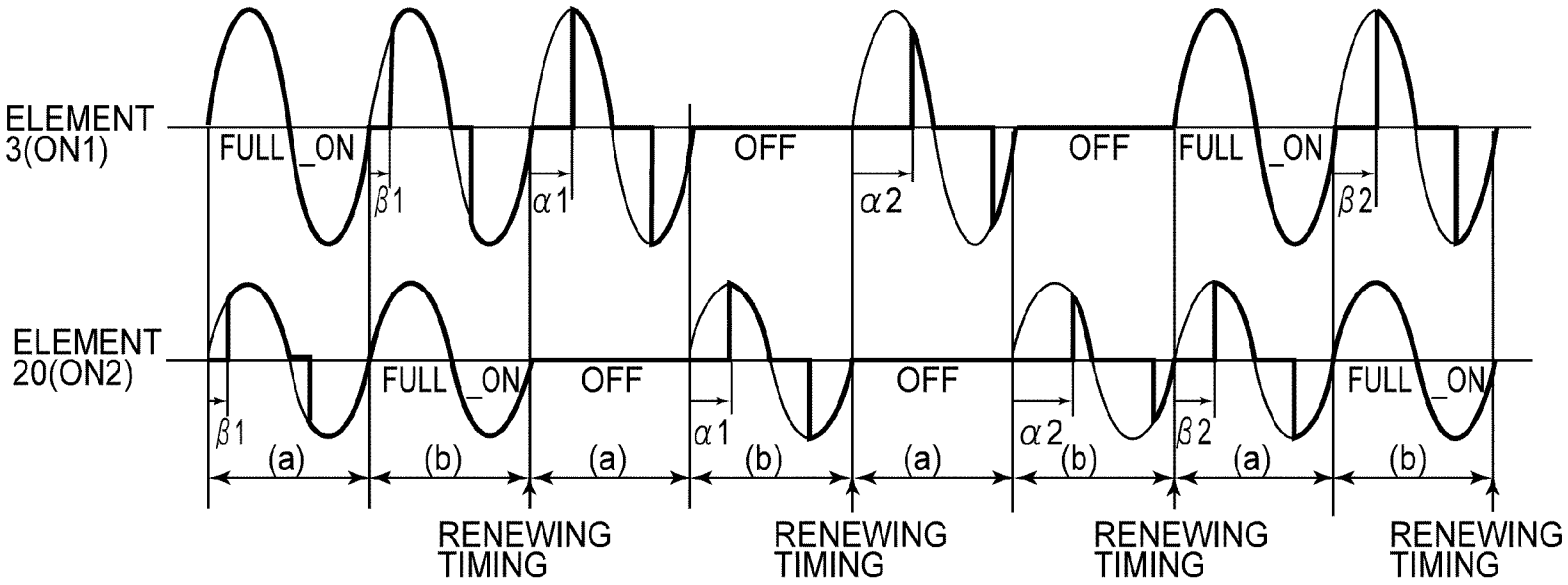
FIG. 6 is a schematic electric power waveform diagram with respect to heat generating elements in Embodiment 1.

A schematic flow chart of a control sequence of the fixing device in this embodiment is shown in FIG. 5. Further, schematic energization waveforms of the heat generating elements 3 and 20 are shown in FIG. 6.

In the engine controller 11, when the start of electric power supply to the ceramic heater 24 is required (S1), the engine controller 11 determines a target fixing temperature on the basis of a size of paper to be passed through the laser printer main assembly and a condition such as an ambient temperature. In the case where the passing paper is small in size or thickness, the target fixing temperature is generally set at a lower value. In the case where the passing paper is large in size or thickness, the target fixing temperature is generally set at a larger value.

The engine controller 11 controls the electric power supplied to the heat generating elements 3 and 20 on the basis of information from the TH signal by PI control so that the temperature is the predetermined temperature set therein. The triac 4 connected to the heat generating element 3 is driven in accordance with the ON1 signal. The triac 13 connected to the heat generating element 20 is driven in accordance with the ON2 signal. From a difference between a predetermined target temperature Tt at a temperature Tn from the TH signal, a control level DN of the electric power to be controlled is computed (S2). The control level DN can, e.g., be determined from the following equation (1):

$$DN=DNp+DNi(t)=Ap\times(Tt-Tn)+Ai/ti\times\Sigma_{t-ti}^{t}(Tt-Tn) \quad (1),$$

wherein DNp represents a control level, which is a manipulated variable (control input) corresponding to proportional control, DNi(t) represents a control level which is a manipulated variable corresponding to integral control at time t, Tn represents a temperature detected by the temperature detecting means, Tt represents the target temperature, Ap represents a coefficient in the proportional control, Ai represents a coefficient in the integral control, and Ti represents an integral period (cycle).

The sum of the control level DNp corresponding to the proportional control and the control level DNi(t) corresponding to the integral control, which are calculated from the equation (1) described above, is the control level DN on the basis of a PI controlling expression (S2).

First, the heat generating element 3 is preferentially controlled (S3). That is, until less than a predetermined control level (in a range of DN from 0 to 24 in Table 1 appearing below), the phase control is effected by only the ON1 signal while turning the ON2 signal off. At a predetermined control level or more (in a range of DN from 25 to 40 in Table 1), the ON1 signal is turned on in full direction ("FULL_ON") and the phase control is effected with the ON2 signal.

For example, in the case where a resistance ratio between the heat generating elements 3 and 20 satisfies the following equation (2):

$$(R1 \text{ of Element } 3):(R2 \text{ of Element } 20)=2:3 \quad (2),$$

wherein R1 is a resistance value of the heat generating element 3 and R2 is a resistance value of the heat generating element 20, a control table (Table 1) is stored in the engine controller 1 and the engine controller 1 effects the control on the basis of the control table. Incidentally, the number of control levels in Table 1 is 40 but may appropriately changed to other predetermined numbers.

TABLE 1

| DN | α (DEG) *1 | β (DEG) *2 | D (%) for 3 *3 | D (%) for 20 *4 | D (%) AV. *5 | H1/H2 AV. *6 |
|---|---|---|---|---|---|---|
| 40 | 0 (FULL) | 0 | 100 | 100 | 100 | 1.5 |
| 39 | 0 | 39.34 | 97.5 | 96.3 | 96.9 | 1.5 |
| . | . | . | . | . | . | . |
| . | . | . | . | . | . | . |
| . | . | . | . | . | . | . |
| 32 | 0 | 90 | 80 | 70 | 75 | 1.5 |
| . | . | . | . | . | . | . |
| . | . | . | . | . | . | . |
| . | . | . | . | . | . | . |
| 24 | 0 | 180 (OFF) | 60 | 40 | 50 | 1.5 |
| . | . | . | . | . | . | . |
| . | . | . | . | . | . | . |
| . | . | . | . | . | . | . |
| 20 | 56.41 | OFF | 50 | 33.3 | 41.7 | 1.5 |
| . | . | . | . | . | . | . |
| . | . | . | . | . | . | . |
| . | . | . | . | . | . | . |
| 16 | 74.64 | OFF | 40 | 26.7 | 33.3 | 1.5 |
| . | . | . | . | . | . | . |
| . | . | . | . | . | . | . |
| . | . | . | . | . | . | . |
| 8 | 105.36 | OFF | 20 | 13.3 | 16.7 | 1.5 |
| . | . | . | . | . | . | . |
| . | . | . | . | . | . | . |
| . | . | . | . | . | . | . |
| 1 | 145.9 | OFF | 2.5 | 1.7 | 2.1 | 1.5 |
| 0 | 180 (OFF) | OFF | 0 | 0 | 0 | |

*1: "α (DEG)" represents a phase angle (degrees) of a priority heat generating element.
*2: "β (DEG)" represents a phase angle (degrees) of an auxiliary heat generating element.
*3: "D (%) for 3" represents a power (electric power) ratio D (%) when the heat generating element 3 is preferentially controlled.
*4: "D (%) for 20" represents a power ratio D (%) when the heat generating element 20 is preferentially controlled.
*5: "D (%) AV." represents an average power ratio D(%).
*6: "H1/H2 AV." represents an average heat generation ratio of H1 (heat generation amount of heat generating element 3)/H2 (heat generation amount of heat generating element 20).

The engine controller 11 determined the phase angle α for the ON1 signal for controlling the heat generating element 3 which is the priority heat generating element and determines the phase angle β for the ON2 signal for controlling the auxiliary heat generating element 20. The engine controller 11 uses the ZEROX signal as a trigger and sends the ON1 signal with the phase angle α as an on-pulse and sends the ON2 signal with the phase angle β as the on-pulse, so that the electric power supplied to the ceramic surface heater 109*c* (24) is controlled by the phase control to effect temperature control (S4). At a commercial frequency of the input power source, the same control is effected in an all-wave period (full-wave period) so that an energization waveform has symmetry of positive and negative half-cycle components with respect to a zero-voltage line. In this case, each of energization waveforms with respect to the heat generating elements 3 and 20 is schematically shown at section (a) in FIG. 6.

In a subsequent all-wave period, the priority heat generating element is switched to the heat generating element 20 (S5). That is, until less than the predetermined control level (in the range of DN from 0 to 24 in Table 1), the phase control is effected by only the ON2 signal while turning off the ON1 signal. At the predetermined control level or more (in the range of DN from 25 to 40 in Table 1), the ON2 signal is turned on in the full period ("FULL_ON") and the phase control is effected with the ON1 signal. The engine controller 11 determines, on the basis of Table 1, the phase angle α for the ON2 signal for controlling the heat generating element 20 which is the priority heat generating element and determines the phase angle β for the ON1 signal for controlling the auxiliary heat generating element 3. These phase angles are set at the same control levels and phase angle values as those in the case where the heat generating element 3 is preferentially controlled. That is, the heat generating element to be preferentially controlled is only switched. The engine controller 11 uses the ZEROX signal as a trigger and sends the ON1 signal with the phase angle β as the on-pulse and sends the ON2 signal with the phase angle α as the on-pulse, so that the electric power supplied to the ceramic surface heater 109*c* (24) is controlled by the phase control to effect temperature control (S6). At a commercial frequency of the input power source, the same control is effected in an all-wave period so that an energization waveform has symmetry of positive and negative half-cycle components with respect to a zero-voltage line. In this case, each of energization waveforms with respect to the heat generating elements 3 and 20 is schematically shown at section (b) in FIG. 6.

Then, until end of the heater temperature control is required, based on Table 1, the temperature control is continued (S7). That is, a renewing period, i.e., a switching period of the control level DN is two all-wave periods which are two times a unit period at the commercial frequency of the input power source (i.e., two cycles of the AC waveform of the commercial power source. Incidentally, the control level DN may also be renewed every period, which is an integral multiple of the two cycles of the AC waveform of the commercial power source (e.g., 4 all-wave periods, 6 all-wave periods, 8 all-wave periods).

FIG. 6 shows a waveform including the following four (first to fourth) renewing periods:

First renewing period in which the priority heat generating element is fully turned on (α=0, FULL_ON) and the auxiliary heat generating element is turned on with the phase angle of β1, Second renewing period in which the priority heat generating element is turned on with the phase angle of α1 and the auxiliary heat generating element is turned off (β=180:OFF), Third renewing period in which the priority heat generating element is turned on with the phase angle of α2 and the auxiliary heat generating element is turned off (β=180:OFF), and Fourth renewing period in which the priority heat generating element is fully turned on (α=0:FULL_ON) and the auxiliary heat generating element is turned on with the phase angle of β2.

In the first and fourth renewing periods, the electric power is insufficient even when the preferentially controlled heat generating element is turned on in the all-wave period of the commercial frequency of the input power source to generate heat, and therefore the other heat generating element is power-controlled with the phase angle at the commercial frequency of the input power source.

Figure 7:
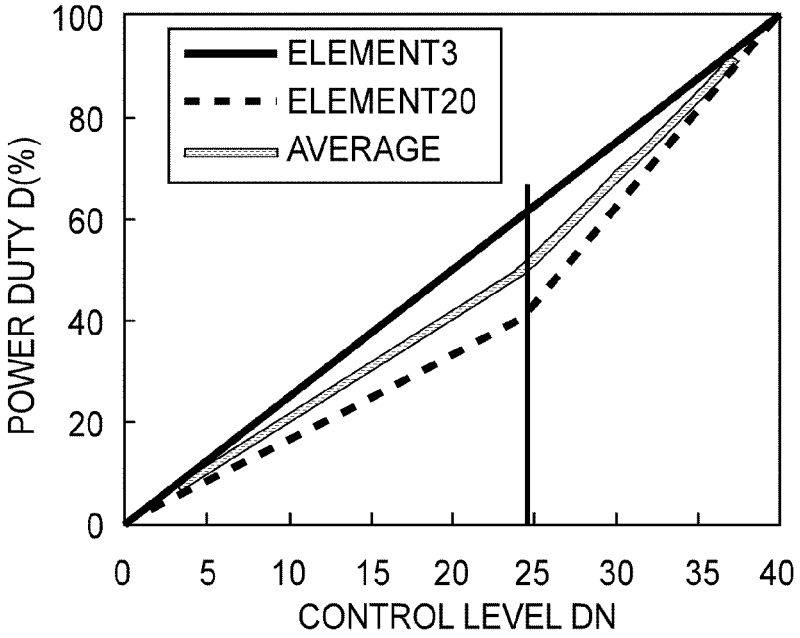
FIGS. 7 and 8 are graphs each for illustrating control of the fixing device in Embodiment 1.

Thus, in Table 1 in this embodiment, the control level DN of the electric power of the engine controller is divided into 40 levels and is set so as to establish a linear relationship with electric power duty in the case where the heat generating element 3 is preferentially controlled. This relationship is shown in FIG. 7. During the renewing period, in the case where the heat generating element 20 is preferentially controlled, the control is effected with the same control level and phase angle as those in the case where the heat generating element 3 is preferentially controlled, so that the electric power duty and the control level do not establish the linear relationship. Therefore, even in the case where the electric power is considered as an average electric power in the removing period, the electric power does not establish the linear relationship with respect to the control level DN.

Figure 8:
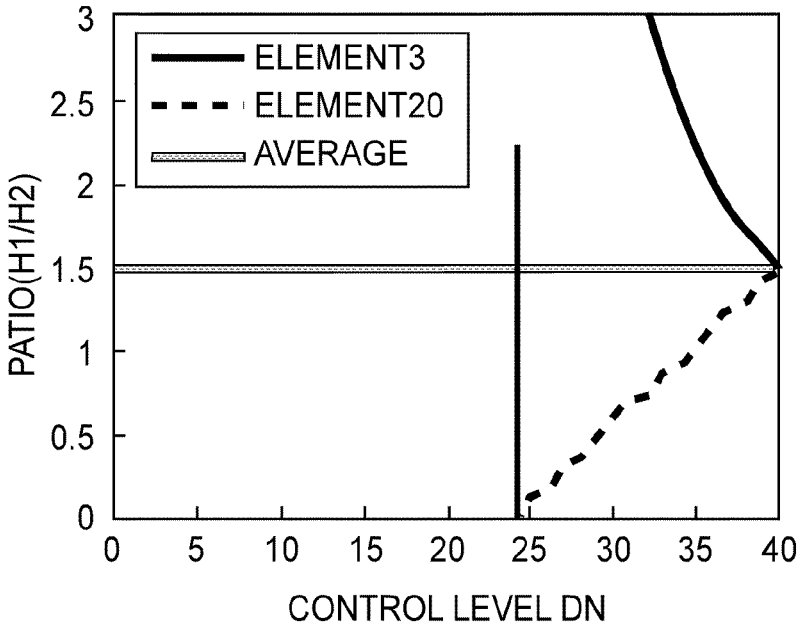

On the other hand, by controlling the heat generating elements with the same phase angle in the renewing period, as shown in FIG. 8, a heat generation (amount) ratio of the heat generating element 3 (H1) to the heat generating element 20 (H2) is constant at 1.5 which is equal to the resistance value ratio determined by the equation (2).

Figure 13:
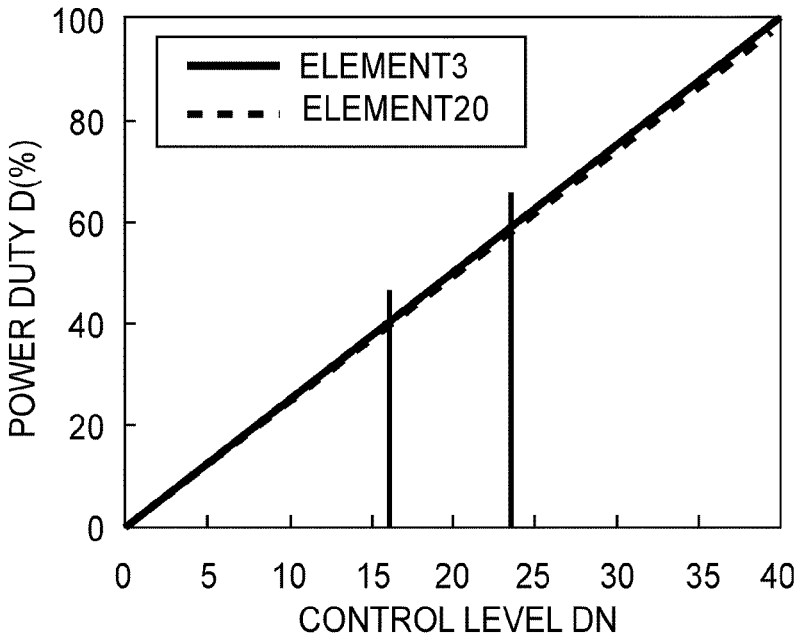
FIGS. 13 and 14 are graphs each for supplementally illustrating the present invention.
Figure 14:
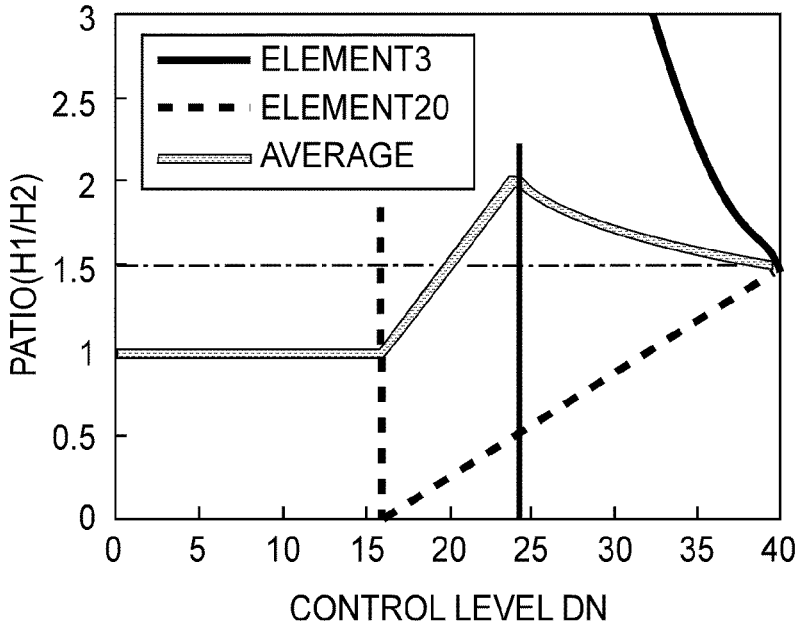

As one means, the relationship between the control level and the phase angle is set depending on the priority heat generating element so that the control level DN and the electric power duty provide the linear relationship even when either of the heat generating elements is preferentially controlled. This relationship is shown in FIG. 13. However, in the case of this control, as shown in FIG. 14, the heat generation ratio of the heat generating element 3 (H1) to the heat generating element 20 (H2) is changed with the control level DN and thus does not correspond to the resistance value ratio determined in the equation (2). Therefore, depending on the control level DN, the temperature distribution of the ceramic surface heater with respect to a sheet passing direction is changed. The average control level DN when the recording paper is passed through the fixing device is changed, depending on the input electric power condition, the thickness of the recording paper (medium) to be passed, a size condition, or the like even when the same target temperature of the fixing device is set. Thus, the temperature distribution is also changed, so that it is difficult to control the temperature distribution. On the other hand, by effecting the control in this embodiment, the heat generation ratio between the two heat generating elements is always kept at a value corresponding to the resistance value ratio, so that it is possible to easily control or estimate the temperature distribution of the ceramic surface heater with respect to the sheet passing direction. The electric power for controlling the heat generating elements is not linear with respect to the control level DN but sufficiently converges by effecting the PI control.

Further, only either one of the heat generating elements is subjected to the phase control, so that current distortion can be suppressed and thus harmonic current can be suppressed. Further, one of the heat generating elements is turned off or fully turned on and the other heat generating element is subjected to the phase control, so that it is possible to not only effect temperature control with less temperature ripple and with accuracy but also reduce flickering.

As described above, the control portion controls the first driving element and the second driving element so that the heat generating element to which the electric power is preferentially supplied is switched from the first heat generating element to the second heat generating element and so that the waveform of the AC passing through the first heat generating element and the second heat generating element keeps symmetry of positive and negative half-cycle components with respect to a zero-voltage line during the control of the first driving element and the second driving element at one control level. Further, the control portion controls the first driving element and the second driving element so that the ratio of the heat generation amount (H1) of the first heat generating element to the heat generation amount (H2) of the second heat generating element becomes constant.

Embodiment 2

In this embodiment, a point similar to that in Embodiment 1 will be omitted from redundant description.

The control sequence is generally identical to that in Embodiment 1 and the energization waveforms of the heat generating elements 3 and 20 are also generally identical to those in Embodiment 6.

The engine controller 11 stores Table 2 shown below as the control table and effects control on the basis of this control table.

TABLE 2

| DN | α (DEG) *1 | β (DEG) *2 | D (%) for 3 *3 | D (%) for 20 *4 | D (%) AV. *5 | H1/H2 AV. *6 |
|---|---|---|---|---|---|---|
| 40 | 0 (FULL) | 0 | 100 | 100 | 100 | 1.5 |
| 39 | 0 | 36.35 | 98 | 97 | 97.5 | 1.5 |
| . | . | . | . | . | . | . |
| . | . | . | . | . | . | . |
| . | . | . | . | . | . | . |
| 30 | 0 | 90 | 80 | 70 | 75 | 1.5 |
| . | . | . | . | . | . | . |
| . | . | . | . | . | . | . |
| . | . | . | . | . | . | . |
| 21 | | 143.65 | | | | |
| 20 | 0 | 180 (OFF) | 60 | 40 | 50 | 1.5 |
| 22 | 36.35 | OFF | | | | |
| . | . | . | . | . | . | . |
| . | . | . | . | . | . | . |
| . | . | . | . | . | . | . |
| 10 | 90 | OFF | 30 | 20 | 25 | 1.5 |
| . | . | . | . | . | . | . |
| . | . | . | . | . | . | . |
| . | . | . | . | . | . | . |
| 1 | 143.65 | OFF | 3 | 2 | 2.5 | 1.5 |
| 0 | 180 (OFF) | OFF | 0 | 0 | 0 | |

Figure 9:
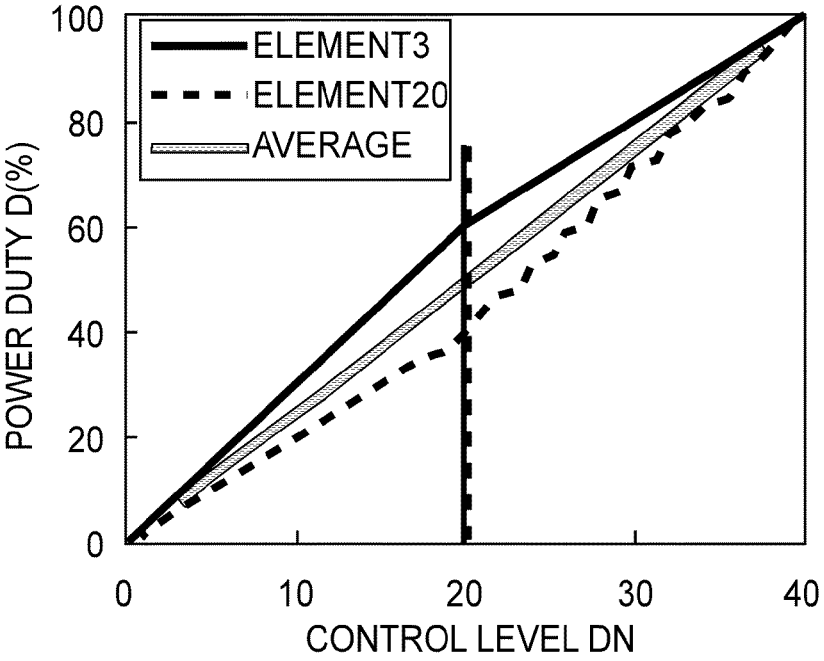
FIGS. 9 and 10 are graphs each for illustrating control of a fixing device in Embodiment 2.

As described above, in Table 2 in this embodiment, the control level DN of the electric power of the engine controller is divided into 40 levels and is set so as to establish a linear relationship with an average of electric power duty in the renewing period in which the heat generating element 3 is preferentially controlled and the renewing period in which the heat generating element 20 is preferentially controlled. This relationship is shown in FIG. 9. During the renewing period, the control is effected with the same control level and phase angle in both of the case where the heat generating element 3 is preferentially controlled and the case where the heat generating element 20 is preferentially controlled, so that the electric power duty and the control level do not establish the linear relationship in either of these cases. The heat generating element which is preferentially controlled is alternately switched in one all-wave period of the commercial frequency of the input power source, so that the average electric power duty in the two all-wave periods which are the renewing period of the control level DN provides the linear relationship with the control level DN. Therefore, by effecting the PI control, it is possible to effect appropriate temperature control.

Figure 10:
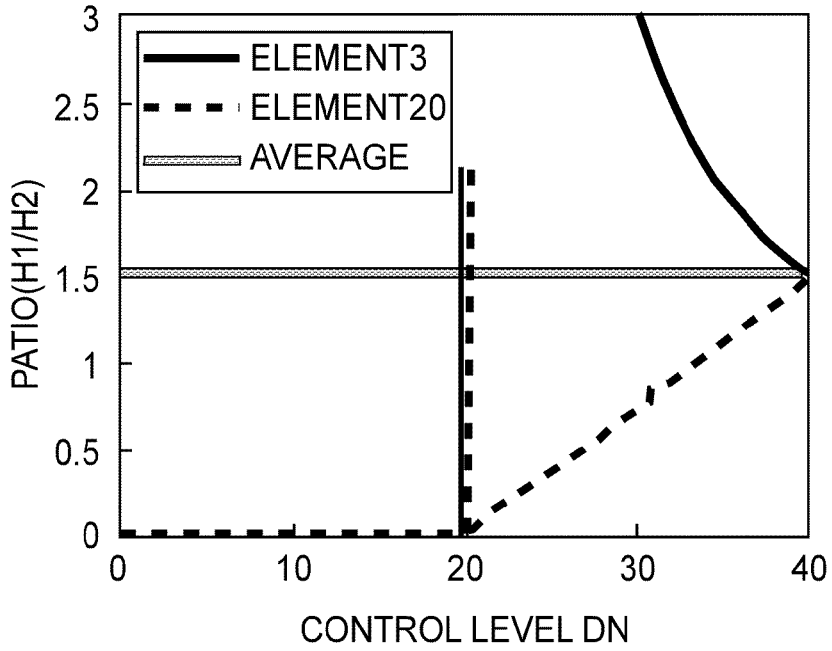

Further, the heat generating elements are controlled with the same phase angle in the renewing period, so that as shown in FIG. 10, a heat generation (amount) ratio of the heat generating element 3 (H1) to the heat generating element 20 (H2) is constant at 1.5, which is equal to the resistance value ratio determined by the equation (2). That is, by effecting the control in this embodiment, the heat generation ratio between the two heat generating elements is always kept at a value corresponding to the resistance value ratio, so that it is possible to easily control or estimate the temperature distribution of the ceramic surface heater with respect to the sheet passing direction. The electric power for controlling the heat generating elements is not linear with respect to the control level DN in the renewing period, so that it is possible to effect the temperature control with less temperature ripples and with high responsiveness by effecting the PI control.

Further, only either one of the heat generating elements is subjected to the phase control, so that current distortion can be suppressed and thus harmonic current can be suppressed. Further, one of the heat generating elements is turned off or fully turned on and the other heat generating element is subjected to the phase control, so that it is possible to not only effect temperature control with less temperature ripple and with accuracy, but also reduce flickering.

Figure 11:
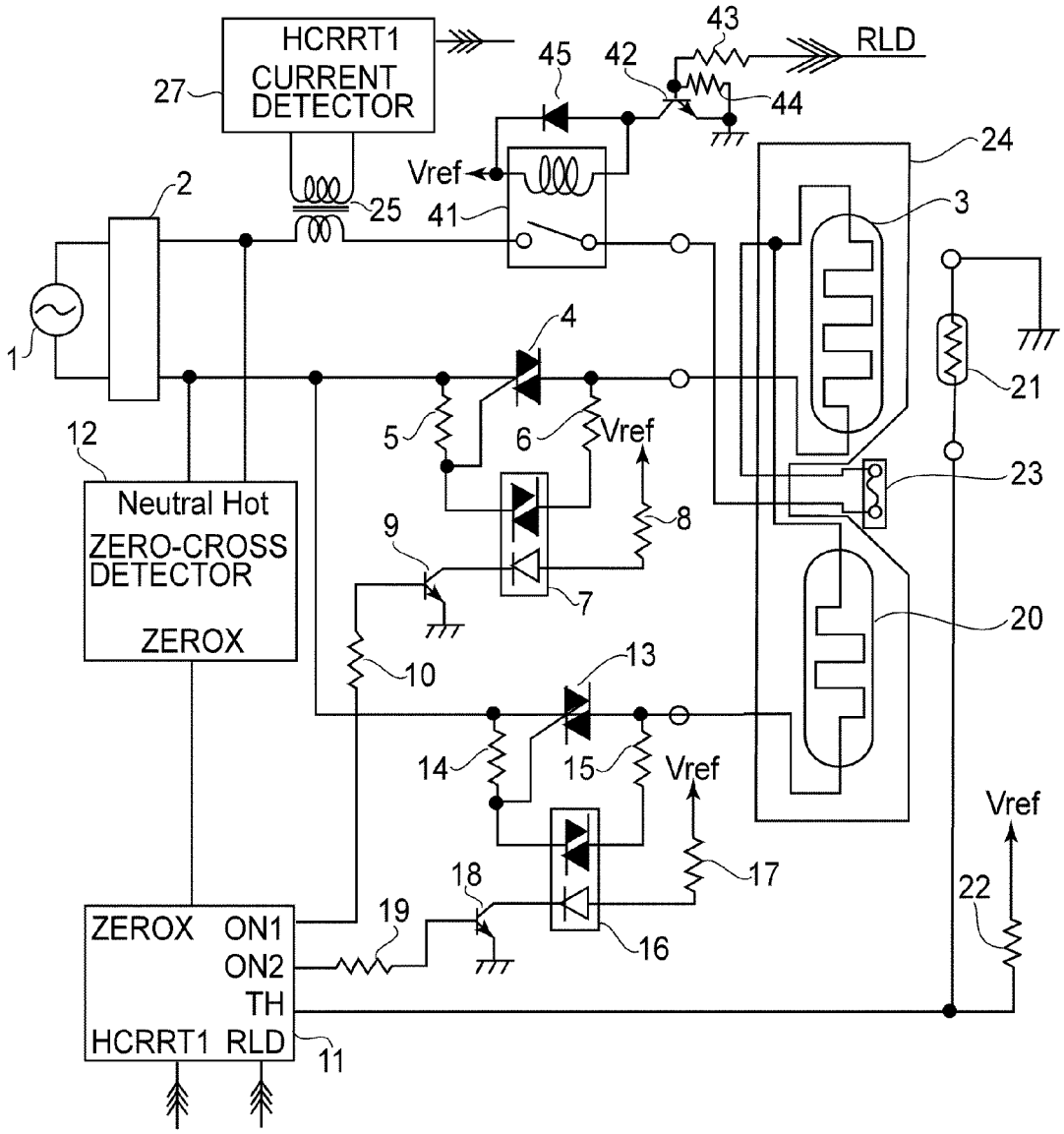
FIG. 11 is a drive and control circuit diagram of a ceramic heater in Embodiment 3.

FIG. 11 shows the drive and control circuit of the ceramic heater in the present invention.

To the AC power source 1, a current transformer 25 is connected through the AC filter 2. The current transformer 25 detects synthetic current passing through the heat generating elements 3 and 20 and is changed as a voltage on the secondary side, and is input into a current detecting circuit 27. The input value is converted into an average, an effective value or a value corresponding to the average or the effective value and is sent to the engine controller 11 as HCRRT1 signal.

In the engine controller 11, an upper limit control level DN limit is calculated by comparing the current value detected from the current detecting circuit 27 with a maximum current, which can be supplied to the heat generating elements 3 and 20, set in the engine controller 11.

Figure 12:
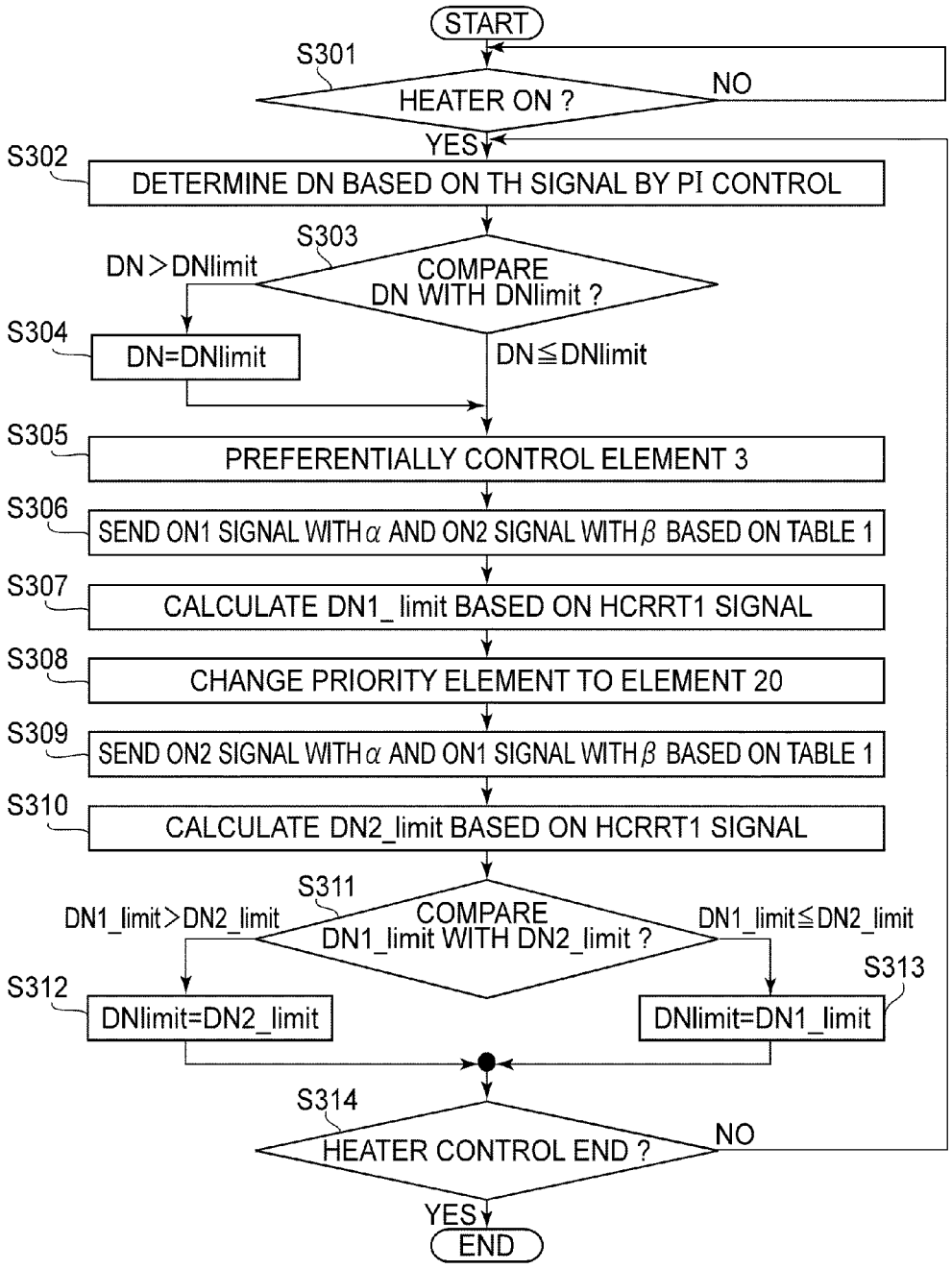
FIG. 12 is a flow chart of a control sequence of a fixing device in Embodiment 3.

A schematic flow chart of a control sequence of the fixing device in this embodiment is shown in FIG. 12.

In the engine controller 11, when start of electric power supply to the ceramic heater 24 is required (S301), the engine controller 11 determines a target fixing temperature on the basis of a size of paper to be passed through the laser printer main assembly and a condition such as an ambient temperature.

The engine controller 11 controls the electric power supplied to the heat generating elements 3 and 20 on the basis of information from the TH signal by PI control so that the temperature is the predetermined temperature set therein. From a difference between a predetermined target temperature Tt at a temperature Tn from the TH signal a control level DN of the electric power to be controlled is computed (S302).

The control level DN and the upper limit control level DN limit determined by the engine controller 11 are compared with each other (S303). When the control level DN is larger than the upper limit control level DN limit, the control level DN is the upper limit control level DN limit. That is, the control is effected at the upper limit control level or less.

First, the heat generating element 3 (first heat generating element) is preferentially controlled (S305).

The engine controller 11 determined the phase angle α for the ON1 signal for controlling the heat generating element 3, which is the priority heat generating element and determines the phase angle β for the ON2 signal for controlling the auxiliary heat generating element 20. The engine controller 11 uses the ZEROX signal as a trigger and sends the ON1 signal with the phase angle α as an on-pulse and sends the ON2 signal with the phase angle β as the on-pulse, so that to the ceramic surface heater 109*c* (24) is temperature-controlled (S306). At a commercial frequency of the input power source, the same control is effected in an all-wave period (full-wave period) so that the energization waveform has symmetry of positive and negative half-cycle components with respect to a zero-voltage line. At this time, an upper limit control level DN1_limit in the case where the priority heat generating element is the heat generating element 3 is calculated from the value of the current passed through the heat generating element as the HCRRT1 signal from the current detecting circuit 27, the control level DN and the set maximum current which can be supplied to the heat generating element (S307). This upper limit control level DN1_limit is a first upper limit control level.

In a subsequent all-wave period, the priority heat generating element is switched to the heat generating element 20 (second heat generating element) (S308). The engine controller 11 determines, the engine controller determines the phase angle α for the ON2 signal for controlling the heat generating element 20, which is the priority heat generating element and determines the phase angle β for the ON1 signal for controlling the auxiliary heat generating element 3. The engine controller 11 uses the ZEROX signal as a trigger and sends the ON1 signal with the phase angle β as the on-pulse and sends the ON2 signal with the phase angle α as the on-pulse, so that the ceramic surface heater 109*c* (24) is temperature-controlled (S309). At a commercial frequency of the input power source, the same control is effected in an all-wave period so that an energization waveform has symmetry of positive and negative half-cycle components with respect to a zero-voltage line. At this time, an upper limit control level DN2_limit in the case where the priority heat generating element is the heat generating element 20 is calculated from the value of the current passed through the heat generating element as the HCRRT1 signal from the current detecting circuit 27, the control level DN and the set maximum current which can be supplied to the heat generating element (S310). This upper limit control level DN2_limit is a second upper limit control level.

The upper limit control level DN1_limit and the upper limit control level DN2_limit are compared with each other (S311), and a smaller upper limit control level is the upper limit control level DN limit (S312, S313).

Then, until the end of the heater temperature control is required, the temperature control is continued (S314). That is, the renewing period of the control level DN is the two all-wave periods of the commercial frequency of the input power source.

As described above, the upper limit control level in the case where each of the heat generating elements is preferentially controlled, is calculated to employ the smaller upper limit control level as the upper limit control level, and in the renewing period, the control level is limited at the same upper limit control level in both of the case where the heat generating element 3 is preferentially controlled and the case where the heat generating element 20 is preferentially controlled. As a result, also in the case where the control is effected so as not to supply current, which is not less than allowable current, to the heating means and the control level is limited, the heat generation ratio between the two heat generating elements is always kept at a value corresponding to the resistance value ratio, so that it is possible to easily control or estimate the temperature distribution of the ceramic surface heater with respect to the sheet passing direction.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 246428/2009 filed Oct. 27, 2009, which is hereby incorporated by reference.

What is claimed is:

1. An image heating apparatus for heating an image formed on a recording material, comprising:

a first heat generating element connected to an alternating-current-producing commercial power source;

a second heat generating element connected to the alternating-current-producing commercial power source, said second heat generating element having a resistance value different from that of said first heat generating element, and generating heat independently of said first heat generating element;

a temperature detecting element; and a control portion for controlling said first heat generating element and said second heat generating element at a control level depending on a detection temperature of said temperature detecting element, wherein said control portion controls said first heat generating element and said second heat generating element by using phase control, and wherein said phase control is control such that in a half-cycle of a waveform of the alternating current, electric power is supplied to said first heat generating element and said second heat generating element at a phase angle depending on the control level, wherein at the control level, a renewing period is two cycles of the waveform of the alternating current or an integral multiple of the two cycles, wherein said control portion controls said first heat generating element and said second heat generating element during the renewing period so that the heat generating element to which the power is to be preferentially supplied is switched from said first heat generating element to said second heat generating element every one cycle of the waveform of the alternating current, wherein said control portion adjusts electric power at levels from a lowest control level to a predetermined control level by supplying electric power to a preferential heat generating element to which the power is to be preferentially supplied, and adjusts electric power at levels from the predetermined control level to a highest control level by fully supplying electric power to the preferential heat generating element and by supplying electric power to an auxiliary heat generating element different from the preferential heat generating element in phase with one cycle, of the waveform of the alternating current, in which the electric power is fully supplied to the preferential heat generating element, and wherein said control portion controls said first heat generating element and said second heat generating element during the renewing period so that the phase angle of the waveform of the alternating current flowing to the first heat generating element when the first heat generating element is the preferential heat generating element and the phase angle of the waveform of the alternating current flowing to the second heat generating element when the second heat generating element is the preferential heat generating element are the same phase angle, and so that the phase angle of the waveform of the alternating current flowing to the first heat generating element when the first heat generating element is the auxiliary heat generating element and the phase angle of the waveform of the alternating current flowing to the second heat generating element when the second heat generating element is the auxiliary heat generating element are the same phase angle.

2. An apparatus according to claim 1, wherein said control portion controls said first heat generating element and said second heat generating element so that the ratio of the amount of heat generation between said first heat generating element and said second heat generating element is constant irrespective of the control level.

3. An apparatus according to claim 1, wherein said first heat generating element and said second heat generating element are provided on a single substrate, and wherein said image heating apparatus further comprises a movable belt in contact with the substrate and a pressing roller creating a nip, in which a recording material is to be nip conveyed, between the pressing roller and the belt contacting the substrate.

4. An apparatus according to claim 1, further comprising a current detecting circuit that detects a current, wherein said control portion sets an upper-limit control level depending on a detected current by said current detecting circuit.

5. An apparatus according to claim 2, wherein the control level is set so as to establish a linear relationship with electric power duty in case where said first heat generating element is preferentially controlled.

6. An apparatus according to claim 2, wherein the control level is set so as to establish a linear relationship with an average of electric power duty in the renewing period in which said first heat generating element is preferentially controlled and in the renewing period in which said second heat generating element is preferentially controlled.

7. An apparatus according to claim 1, wherein said temperature detecting element detects a temperature of said first heat generating element and said second heat generating element.

8. An apparatus according to claim 3, wherein said first heat generating element has a resistance value higher than a resistance value of said second heat generating element, and said first heat generating element is disposed upstream of said second heat generating element with respect to a conveyance direction of the recording material.

9. An image heating apparatus for heating an image formed on a recording material, comprising:

a first heat generating element connected to an alternating-current-producing commercial power source;

a second heat generating element connected to the alternating-current-producing commercial power source, said second heat generating element having a resistance value different from that of said first heat generating element, and generating heat independently of said first heat generating element;

a temperature detecting element; and a control portion for controlling said first heat generating element and said second heat generating element at a control level depending on a detection temperature of said temperature detecting element, wherein said control portion controls said first heat generating element and said second heat generating element by using phase control, and wherein said phase control is control such that in a half-cycle of a waveform of the alternating current, electric power is supplied to said first heat generating element and said second heat generating element at a phase angle depending on the control level, wherein at the control level, a renewing period is two cycles of the waveform of the alternating current or an integral multiple of the two cycles, wherein said control portion controls said first heat generating element and said second heat generating element during the renewing period in a manner such that:

(a) every one cycle of the waveform of the alternating current, a preferential heat generating element to which the power is to be preferentially supplied and an auxiliary heat generating element different from the preferential heat generating element are switched with respect to each other, (b) when the electric power is more than the electric power corresponding to the control level by only electric power supply to the preferential heat generating element, in an equiphase one cycle of the waveform of the alternating current, the electric power is not supplied to the auxiliary heat generating element, (c) when the electric power is less than the electric power corresponding to the control level by only electric power supply to the preferential heat generating element, in an equiphase one cycle of the waveform of the alternating current, the electric power is supplied to the auxiliary heat generating element, (d) the phase angle of the waveform of the alternating current flowing to the first heat generating element when the first heat generating element is the preferential heat generating element and the phase angle of the waveform of the alternating current flowing to the second heat generating element when the second heat generating element is the preferential heat generating element are made the same phase angle, and (e) the phase angle of the waveform of the alternating current flowing to the first heat generating element when the first heat generating element is the auxiliary heat generating element and the phase angle of the waveform of the alternating current flowing to the second heat generating element when the second heat generating element is the auxiliary heat generating element are made the same phase angle.

10. An apparatus according to claim 9, wherein said control portion controls said first heat generating element and said second heat generating element so that the ratio of the amount of heat generation between said first heat generating element and said second heat generating element is constant irrespective of the control level.

11. An apparatus according to claim 9, wherein said first heat generating element and said second heat generating element are provided on a single substrate, and wherein said image heating apparatus further comprises a movable belt in contact with the substrate and a pressing roller creating a nip, in which a recording material is to be nip conveyed, between the pressing roller and the belt contacting the substrate.

12. An apparatus according to claim 9, further comprising a current detecting circuit that detects a current, wherein said control portion sets an upper-limit control level depending on a detected current by said current detecting circuit.

13. An apparatus according to claim 9, wherein the control level is set so as to establish a linear relationship with the electric power duty in case where said first heat generating element is preferentially controlled.

14. An apparatus according to claim 9, wherein the control level is set so as to establish a linear relationship with an average of the electric power duty in the renewing period in which said first heat generating element is preferentially controlled and in the renewing period in which said second heat generating element is preferentially controlled.

15. An apparatus according to claim 9, wherein said temperature detecting element detects a temperature of said first heat generating element and said second heat generating element.

16. An apparatus according to claim 11, wherein said first heat generating element has a resistance value higher than a resistance value of said second heat generating element, and said first heat generating element is disposed upstream of said second heat generating element with respect to a conveyance direction of the recording material.

* * * * *